United States Patent [19]

Sastry et al.

[11] Patent Number: 4,639,281

[45] Date of Patent: Jan. 27, 1987

[54] ADVANCED TITANIUM COMPOSITE

[75] Inventors: Shankar M. Sastry, Chesterfield; James E. O'Neal, Bridgeton; Tzy C. Peng, St. Louis, all of Mo.

[73] Assignee: McDonnell Douglas Corporation, St. Louis, Mo.

[21] Appl. No.: 557,597

[22] Filed: Dec. 2, 1983

Related U.S. Application Data

[63] Continuation-in-part of Ser. No. 350,276, Feb. 19, 1982.

[51] Int. Cl.[4] ..... C22C 14/00

[52] U.S. Cl. ..... 148/407; 148/421; 420/417; 420/418; 420/419; 420/420; 420/421

[58] Field of Search ..... 148/403, 421, 407; 420/417, 418, 420, 419, 421

[56] References Cited

U.S. PATENT DOCUMENTS

| | | | |
|---|---|---|---|
| 3,052,538 | 9/1962 | Jech et al. | 148/407 |
| 3,070,468 | 12/1962 | Grant | 148/20.3 |
| 3,159,908 | 12/1964 | Anders, Jr. | 29/182.5 |
| 3,205,099 | 9/1965 | Vordahl | 148/421 |
| 3,379,522 | 4/1968 | Vordahl | 148/407 |
| 3,622,406 | 11/1971 | Vordahl | 148/407 |
| 3,679,403 | 7/1972 | Bomberger et al. | 75/175.5 |
| 3,728,088 | 4/1973 | Benjamin | 29/182.5 |
| 3,807,995 | 4/1974 | Dohogne | 75/175.5 |

FOREIGN PATENT DOCUMENTS

| | | | |
|---|---|---|---|
| 2114154 | 8/1983 | United Kingdom | 148/421 |

OTHER PUBLICATIONS

Cohen, M. et al., "Rapid Solidification Processing—An Outlook," *Rapid Solidification Processing Principles and Technologies,* II, Mehrabian et al., ed., 1980, pp. 1–23.

Dixon et al., "Dispersion Strengthening and Titanium with Refractory Oxides", *The Canadian Metallurgical Quarterly,* vol. 11, 1972, pp. 491–495.

"Influence of Rare-Earth Additions on Properties of Titanium Alloys", by C. R. Whitesett, S. M. L. Sastry, J. E. O'Neal, and R. J. Lederich, 31 May 1977.

"The Effect of Yttrium and Erbium Dispersoids on the Deformation Behavior of Titanium", by S. M. L. Sastry, J. E. O'Neal, R. J. Lederich, B. B. Rath, *Journal of Materials Science,* 14 (1979), pp. 179–183.

"Microstructural Studies of Laser-Melted Titanium-Rare-Earth and Titanium Boron Alloys", by J. E. O'Neal, T. C. Peng, and S. M. L. Sastry, Proceedings of the Thirty-Ninth Annual Meeting of the Electron Microscopy Society of America, p. 66, 1981.

"Properties and Applications of Dispersion-Strengthened Metals", by S. M. Wolf, Journal of Metals, Jun. 1967, pp. 22–28.

"Grain Growth Kinetics in Ti-N Alloys", by K. Okazaki, M. Momochi, and H. Conrad, *Titanium Science and Technology,* vol. 3, 1973, pp. 1649–1660.

"Methods of Refining Coarse-Grained Structures of Titanium Alloys", by L. A. Elagina,, A. I. Gordienko, O. P. Evemenov, and V. V. Ivashko, *Titanium and Titanium Alloys,* vol. 3, 1982, pp. 1789–1798.

"Titanium P/M Preforms, Parts and Composites", by S. Abkowitz, *Titanium Science and Technology,* vol. 1, 1973, pp. 381–398.

*Primary Examiner*—L. Dewayne Rutledge
*Assistant Examiner*—Deborah Yee
*Attorney, Agent, or Firm*—Edward H. Renner

[57] ABSTRACT

A titanium alloy has greatly increased specific strength and increased thermostability. The alloy consists of a titanium matrix in which fibrous dispersoids are formed in situ. The dispersoids are rod and/or plate shaped and have a diameter or depth of about 0.1–0.5 microns and an aspect ratio of about 5–10. A typical alloy has the composition A-X where A is titanium or titanium alloy and X is boron, carbon, nitrogen, mixtures thereof, or mixtures with silicon.

11 Claims, 4 Drawing Figures

Ti-1.0B Alloy: Splat-Quenched + 3 h at 900°C

Ti-B Precipitates

2 μm

Ti-1.0B Alloy: Splat-Quenched + 3 h at 900°C

Ti-B Precipitates

Ti-1,OC ALLOY

CONVENTIONALLY CAST

510X

RAPIDLY SOLIDIFIED ANNEALED AT 840°C FOR 2 H,

4920X

ADVANCED TITANIUM COMPOSITE

BACKGROUND AND SUMMARY OF THE INVENTION

This is a continuation-in-part of our co-pending patent application Ser. No. 350,276 filed Feb. 19, 1982, entitled Rapid Solidification Processed Dispersion Hardened Titanium Alloy, the disclosure of which is incorporated by reference herein.

Titanium and titanium alloys are extremely valuable where light weight and high strength to weight ratio are important. The aircraft industries and other transportation industries, in particular, find such alloys highly useful. Known titanium alloys have a high strength to weight ratio. However, applicants have discovered that the strength to weight ratio, the specific strength, can be greatly increased. This great increase in strength is brought about by the in situ inclusion of fibrous particles in the titanium alloy matrix resulting in a fibrous reinforced titanium matrix.

Filamentary or fibrous second phases have previously been used to reinforce metals, by combining externally formed filamentary reinforcing material in the matrix, by making a laminated composite, or by other conventional procedures. These techniques, while on occasion producing composites of high strength, suffer from poor reproducability of properties, degragration of the fiber matrix composite during processing and from high cost. In addition, the methods are all very awkward. It is extremely difficult to continuously produce whisker reinforced composites, for example. Moreover, deformation of filament reinforced composites is limited to very small strains, thus restricting the use of the composites to applications where secondary forming operations are not necessary.

Applicants have found that a high strength, fibrous reinforced titanium matrix can be produced by rapid solidification processing, eliminating the cost and production problems of conventional composites. Applicants have discovered that certain dispersoid forming elements in titanium, when formed by using rapid solidification processing, produce large aspect ratio plate and/or fibrous second phases, similar in form and strength to fibers used in conventional titanium matrix composites, but without the additional steps necessary to form composites. Applicants have found that matrices having filamentary second phases can be produced by this method, which have an increase in specific modulus of 30–70% or more, 50–100% or more increase in specific strength, and about 200°–300° C. increases in service temperature capabilities over conventional titanium base alloys. The fibrous containing titanium matrices can be worked by conventional processing and secondary forming techniques.

Applicants are aware of the following U.S. Patents, the disclosures of which are incorporated by reference herein:

U.S. Pat. No. 3,070,468
U.S. Pat. No. 3,159,908
U.S. Pat. No. 3,622,406
U.S. Pat. No. 3,679,403
U.S. Pat. No. 3,728,088
U.S. Pat. No. 3,807,995

DESCRIPTION OF THE PREFERRED EMBODIMENTS

Applicants' high strength titanium alloys are composed principally of titanium. This includes titanium and titanium alloys. Examples of titanium alloy compositions are Ti-Al, Ti-Al-Er, Ti-Al-V, Ti-Al-Nb, Ti-Al-Ni, Ti-Al-Sn, Ti-Al-Mo-V, Ti-Al-Sn-Zr-Mo, and Ti-V-Cr-Zr-Sn. The strengthened alloys may be described by the general formula A-X where A is the base alloy matrix, such as the titanium and titanium alloys described above, and X is the fibrous dispersoid forming material, such as B, N, B-N, C, Si-C, B-C, or Si-N, in particular. The alloys may contain trace elements of the type normally found in titanium and titanium alloys, for example, commercial grade alloys, such as carbon and oxygen. It should be appreciated that these will be found at or below the level at which they detract significantly from the properties of the alloys described herein.

Figure 3:
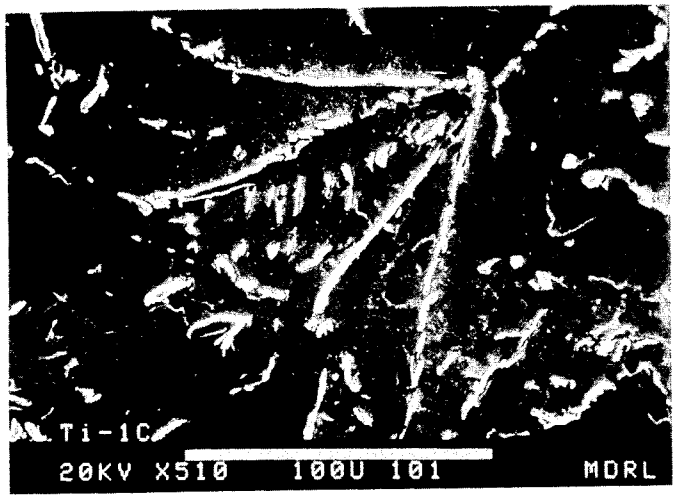
FIG. 3 is a comparative photomicrograph of an in situ fibrous reinforced Ti-1.0C alloy, taken at 4920 magnification, and an agglomerated dispersoid Ti-1.0C alloy produced by conventional casting, taken at 510 magnification.
Figure 3:
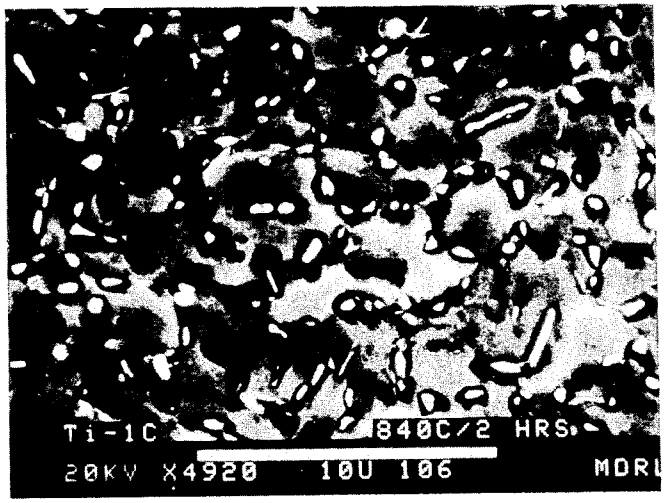

We have found that the strengthening effect is dependent upon formation of dispersoids which are of a fibrous nature, that is, those which have a non-spherical shape, for example filamentary or plate like forms. The dispersoids generally have an aspect ratio, that is, length to depth or length to diameter ratio, of between about 5–10. Typically, the particles will have a diameter or depth of between 0.1–0.5 microns. The dispersoids will be uniformly distributed throughout the alloy matrix, at a close spacing, with a high volume fraction of the dispersoids being plate and/or rod shaped, typically between about 5–15%. The strengthening effect is believed to be accomplished by the rule of mixtures. The fibrous dispersoids formed in the alloy matrix have a very high modulus which provides a proportionate strengthening effect on the matrix as a whole. The rapidly solidified alloy of FIG. 3 is an alloy according to the invention. The bar in the legend shows a distance of 10 microns.

The alloy matrix itself has a very highly refined grain structure, with the significant improvement in strength noted above, brought about by the fibrous dispersoids which are formed in situ in the matrix. It will be understood that this is an unexpected property. Normally agglomerated or non-spherical dispersoids have the effect of embrittling and weakening the structure of an alloy of which they are a part, by providing areas of stress concentration. The conventional Ti-1.0C alloy shown in FIG. 3 is typical of previous alloys having agglomerated, non-spherical dispersoids which weaken the alloy. The bar in the legend shows a distance of 100 microns. The alloys formed by applicants typically are stable up to 800° centigrade or more, and strength is increased over alloys not having fibrous dispersoids, both at room temperature and at elevated temperatures.

The alloys are highly desirable, where performance, reliability, and maintainability are important. This includes most aspects of the transportation industry where weight reduction is an extremely important consideration due to the fuel savings which can be obtained by reducing the weight of structures, if the strength of those structures can be maintained.

Applicants have found that the alloys of the above composites, having dispersoids of sufficient size and fibrous structure to effectively increase the specific strength of the titanium matrix, must be produced using rapid solidification techniques. The processes used must have cooling rates greater than $10^3$ degrees centigrade per second. Suitable techniques include conventional processes, such as ultrasonic gas atomization, electron beam melting/splat quenching, and rotating electrode processes. Rapid solidification produces thermally stable particles and alters the properties of the base metal. Typically, the rapid solidification produces composite powder particles having a diameter of 50–150 microns. Conventional ingot metallurgy is not a suitable method of producing in situ fibers because of the limited solubility of the compound forming materials and the precipitation in the melt of coarser equilibrium constitutent particles.

When formed, the rapidly solidified alloy powder is consolidated to full density by hot pressing or by other conventional methods. Rapid solidification of the titanium alloys by the method disclosed produces titanium alloys containing the fine, homogeneously dispersed, fibrous dispersoid forming particles described herein.

It is believed that the reinforced titanium matrix produced by applicants is an alloy composite, having boride, carbide, and nitride fibrous reinforcement in the titanium matrix, or mixtures thereof. Complex silicon-carbide, silicon-nitride, boron-nitride, and boron-carbide fibrous dispersoids may also be produced. The fibrous reinforcement is produced by the in situ rapid solidification and subsequent annealing of the boron, silicon, carbon, and nitrogen containing titanium alloys. The fibrous dispersoid forming material is effective to produce substantial increase in strength at very low proportions of the total alloy weight. Normally the proportion of fibrous dispersoid forming material will be between about 0.1 to 2% by weight. The amount is not critical. Greater or lesser amounts may be used, but the increase in strength is not as significant outside of these ranges. For example, large additions of dispersoid forming material outside this range do not result in any substantial additional increase in strength. Increasing the cooling rate above $10^{3°}$ C. per second during rapid solidification permits inclusion of greater amounts of fibrous dispersoid forming material in the alloy matrix.

Figure 1:
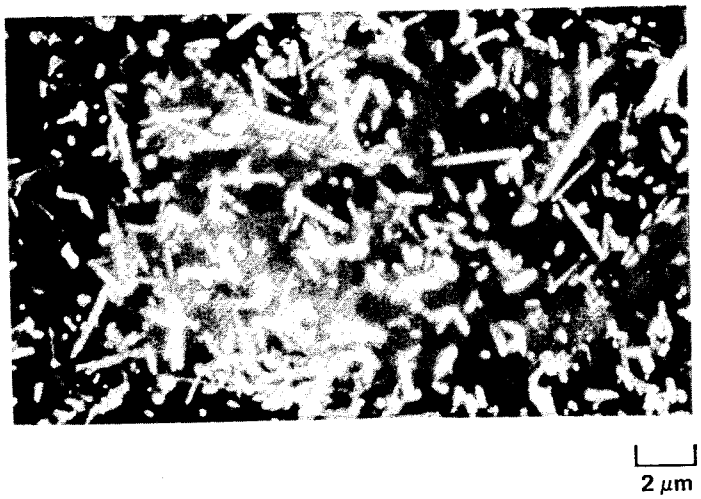
FIG. 1 is a photomicrograph of an in situ fibrous reinforced, titanium-boron alloy.
Figure 2:
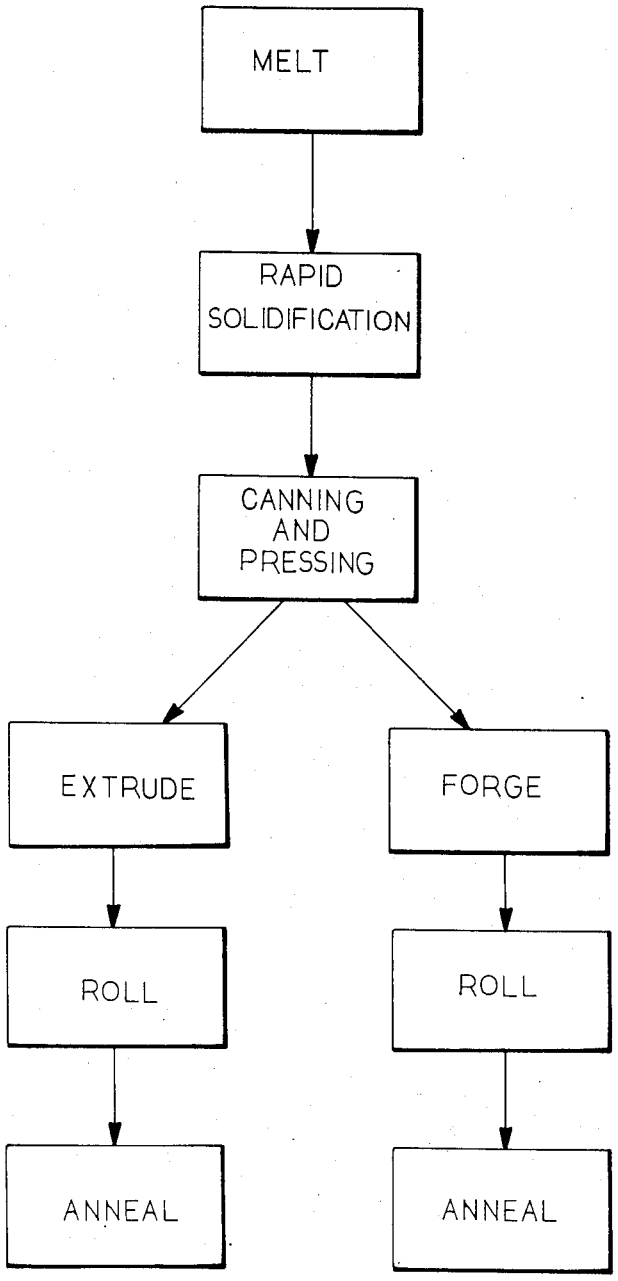
FIG. 2 is a drawing of the process flow for producing applicants' in situ fibrous reinforced matrices.

In producing fibrous reinforced titanium matrices, for example, as shown by the schematic diagram of FIG. 2, the metal is melted and subjected to rapid solidification to form rapidly solidified powder. The melt is formed of the mixed base titanium metal or alloy and the fibrous dispersoid forming material. Melting may be performed by a variety of conventional methods, such as electron beam melting, followed by a splat quenching or other rapid solidification methods, as described herein. On rapid solidification, the fibrous dispersoid containing material is dispersed throughout the matrix of the rapidly solidified alloy powder. It will be appreciated that the rapid solidification must be conducted under conditions which will produce a cooling rate of greater than $10^{3°}$ C. per second. The collected rapidly solidified powder is then processed to produce a billet having about the theoretical density, for example, by canning and hot isostatic pressing. The dense billet is then further processed, for example, by extrusion or forging and subsequent rolling, to produce metal stock of theoretical density. The dense stock is further treated, by annealing, to form stock containing the reinforcing fibrous dispersoids. It will be appreciated that the combination of rapid solidification and a subsequent annealing treatment is effective to produce fibrous and/or plate like dispersoids as described herein. Typically, the annealing treatment will be from between about 700° to 900° C. and for times of from between about 1 to 10 hours.

Applicants' Table shows the properties a fibrous reinforced titanium alloy produced according to the invention. The alloys described in the Table were rapidly solidified by electron beam melting and splat quenching, as known in the art, and formed by canning and hot isostatic pressing. The pressed alloys were further processed by forging and rolling to form a test stock which was then annealed as shown in the Table. Notice particularly that the yield strength was increased over that of the base alloy by as much as 100%, from 300 to 600 MPa. The ultimate strength was increased 75%, from 400 to 700 MPA, and the ductility remained at an acceptably high level. In some instances, depending on the base alloy, the ultimate strength of the in situ fibrous reinforced alloy may be increased to as much as 1400 MPa or more, for example, where the base alloy is Ti-6Al-4V, Ti-6Al-2Sn-4Zr-2Mo, Ti-8Al-1Mo-1V or the like.

Tensile Properties of Rapidly Solidified Titanium and Titanium Alloys

| Alloy Titanium | Young's Modulus (GPa) | 0.2% Yield Stress (MPa) | Ultimate Tensile Stress (MPa) | Total Elongation to Fracture (%) | Annealing Treatment |
|---|---|---|---|---|---|
| Titanium | 80 | 300 | 400 | 22 | 1 hr. at 900° C. |
| Titanium 0.5 B | 130 | 600 | 700 | 11 | 1 hr. at 900° C. |

It will be apparent to those skilled in the art that many variations of the specific alloys described herein may be made without departing from the spirit of the invention. The specific embodiments are to be considered in all their aspects and are for purposes of illustration. The specific embodiments are not restrictive of the scope of the invention. The scope of the invention herein is to be determined by the claims which are appended hereto and their equivalants.

I claim:

1. In an annealed titanium alloy, the improvement consisting essentially of the inclusion of anneal developed in situ formed fibrous dispersoids in a rapidly solidified titanium matrix, the dispersoids being effective to produce an increased strength in the resulting alloy.

2. The alloy of claim 1 where the alloy has the formula of A-X and where A is selected from the group consisting of titanium and titanium alloys selected from the group consisting of Ti, Ti-Al, Ti-Al-Er, Ti-Al-V, Ti-Al-Nb, Ti-Al-Ni, Ti-Al-Sn, Ti-Al-Mo-V, Ti-Al-Sn-Zr-Mo, or Ti-V-Cr-Zr-Sn.

3. The alloy of claim 2 where X is a dispersoid forming materials selected from the group consisting of C, B, B-N, Si-C, B-C, Si-N, N, and mixtures thereof.

4. The alloy of claim 1 wherein the proportion of dispersoid forming material is up to about 2% by weight of the resulting alloy.

5. The alloy of claim 1 where the alloy has an increase in specific strength of up to 50% or more over comparably treated non-fibrous dispersoid containing titanium alloys.

6. The alloy of claim 5 wherein the specific strength is increased up to about 1400 MPa or more.

7. The alloy of claim 1 wherein the dispersoids are predominantly plate-like, rod-like, or mixtures thereof.

8. The alloys of claim 7 wherein the dispersoids have diameter of between about 0.1 and 0.5 microns and have an aspect ratio between about 5 and 10.

9. The alloy of claim 1 wherein the dispersoids are borides, carbides, or nitrides of titanium or mixtures thereof with each other or with silicon.

10. The alloy of claim 1 wherein the alloy has a 0.2% yield stress of up to about 600 MPa and an ultimate tensile strength of up to about 700 MPa.

11. The alloy of claim 3 wherein the proportion of dispersoid forming material is up to about 2% by weight of the resulting alloy.

* * * * *